US007992622B2

(12) United States Patent
Newman et al.

(10) Patent No.: US 7,992,622 B2
(45) Date of Patent: Aug. 9, 2011

(54) OIL COOLER FITTING ASSEMBLY

(75) Inventors: Daniel S Newman, Amherst, NY (US); Timothy John Peters, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 1120 days.

(21) Appl. No.: 11/803,524

(22) Filed: May 15, 2007

(65) Prior Publication Data

US 2008/0283227 A1 Nov. 20, 2008

(51) Int. Cl.

| | |
|---|---|
| ***B60H 1/00*** | (2006.01) |
| ***F28D 7/10*** | (2006.01) |
| ***F28F 9/04*** | (2006.01) |
| ***F16L 35/00*** | (2006.01) |
| ***F16L 37/00*** | (2006.01) |
| ***F16L 39/00*** | (2006.01) |
| ***F16L 41/00*** | (2006.01) |
| ***F16L 55/00*** | (2006.01) |

(52) U.S. Cl. ..... 165/41; 165/140; 165/178; 285/3; 285/140.1; 285/319

(58) Field of Classification Search ..... 165/41, 165/140, 178; 285/3, 4, 140.1, 319, 321
See application file for complete search history.

(56) References Cited

U.S. PATENT DOCUMENTS

| | | | | |
|---|---|---|---|---|
| 4,181,329 | A * | 1/1980 | Helm | 285/321 |
| 4,519,449 | A * | 5/1985 | Hoskins et al. | 285/140.1 |
| 4,538,679 | A * | 9/1985 | Hoskins et al. | 165/140 |
| 4,749,214 | A * | 6/1988 | Hoskins et al. | 285/319 |

* cited by examiner

*Primary Examiner* — Ljiljana (Lil) V Ciric
(74) *Attorney, Agent, or Firm* — Patrick M. Griffin

(57) ABSTRACT

A fitting assembly for connecting an oil cooler assembly to a radiator assembly in a vehicle cooling system includes a radiator having an inlet header tank with an outer wall. The outer wall includes an inlet cooler opening and an outlet cooler opening disposed in the outer wall. The inlet cooler opening is disposed about an inlet axis and the outlet cooler opening is disposed about an outlet axis. An oil cooler having an inlet manifold and an outlet manifold is disposed within the header tank. A fitting interconnects the oil cooler and the header tank of the radiator. A pair of tracks are integrated with the outer wall and are disposed within the header tank. A spring clip extends between the tracks and the fitting for retaining the fitting to the header tank.

15 Claims, 5 Drawing Sheets

OIL COOLER FITTING ASSEMBLY

BACKGROUND OF THE INVENTION

1. Field of the Invention

The subject invention relates to a fitting assembly for connecting an oil cooler to a radiator tank in a vehicle cooling system.

2. Description of the Prior Art

Automotive engines are generally cooled using a radiator for transferring heat from a liquid to cool the engine. Typically, the heat exchanger includes a pair of tanks with tubes connected therebetween for delivering fluid between the two tanks. An oil cooler may be disposed within at least one of the tanks. The header tanks include cooler openings for receiving an oil line that engages the oil cooler for delivering oil thereto.

A two-piece fitting assembly is traditionally disposed between the oil cooler and the radiator tank for sealing the fitting against the tank wall. The traditional two-piece fitting assembly includes a fitting defining a threaded inner wall and an integrated quick-connect having a threaded portion for engaging the inner wall of the fitting. The quick-connect includes a washer for engaging the outer wall of the radiator tank. The washer provides a downward force against the radiator tank that compresses the fitting against the wall of radiator tank.

Consequently, the traditional two-piece fitting assembly provides potential leak paths between the threads of the inner wall of the fitting and the quick-connect where oil may escape and leak into the radiator tank. Further, the additional quick-connect component increases manufacturing processes and overall costs.

SUMMARY OF THE INVENTION AND ADVANTAGES

The invention provides for a fitting assembly for connecting an oil cooler to a radiator tank in a vehicle cooling system. A radiator includes an inlet header tank having an outer wall. The outer wall has at least one inlet cooler opening therein disposed about an inlet axis. An oil cooler is disposed within the header tank. At least one fitting extends into the cooler opening for interconnecting the oil cooler and the header tank of the radiator. The fitting assembly further includes a clip for retaining the fitting to the header tank. At least one track extends from the outer wall within the header tank with the clip extending between the track and the fitting within the tank.

Accordingly, the fitting assembly eliminates the quick-connect component traditionally used to retain the fitting to the header tank. Therefore, the possibility of fluid leaking between the threads of the inner wall of the fitting and the quick-connect component is eliminated and instances where oil escapes into the radiator tank is reduced. Additionally, disposing the clip inside the header tank protects the clip from external damage. The fitting assembly of the present invention also reduces the components required to retain the fitting to the radiator tank. Therefore, overall costs to manufacture the fitting assembly is reduced.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
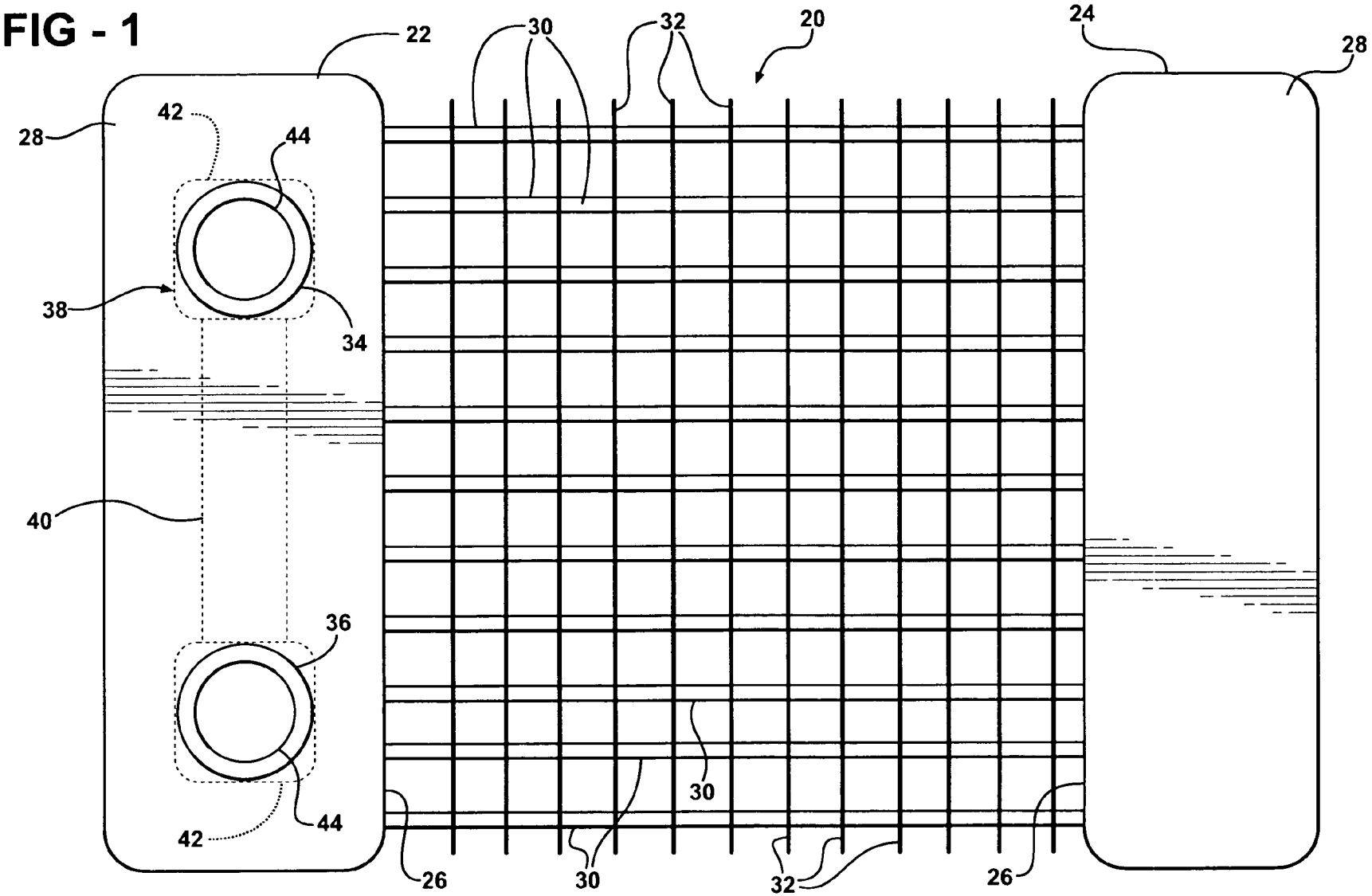
FIG. 1 is a view of a traditional radiator assembly.
Figure 5:
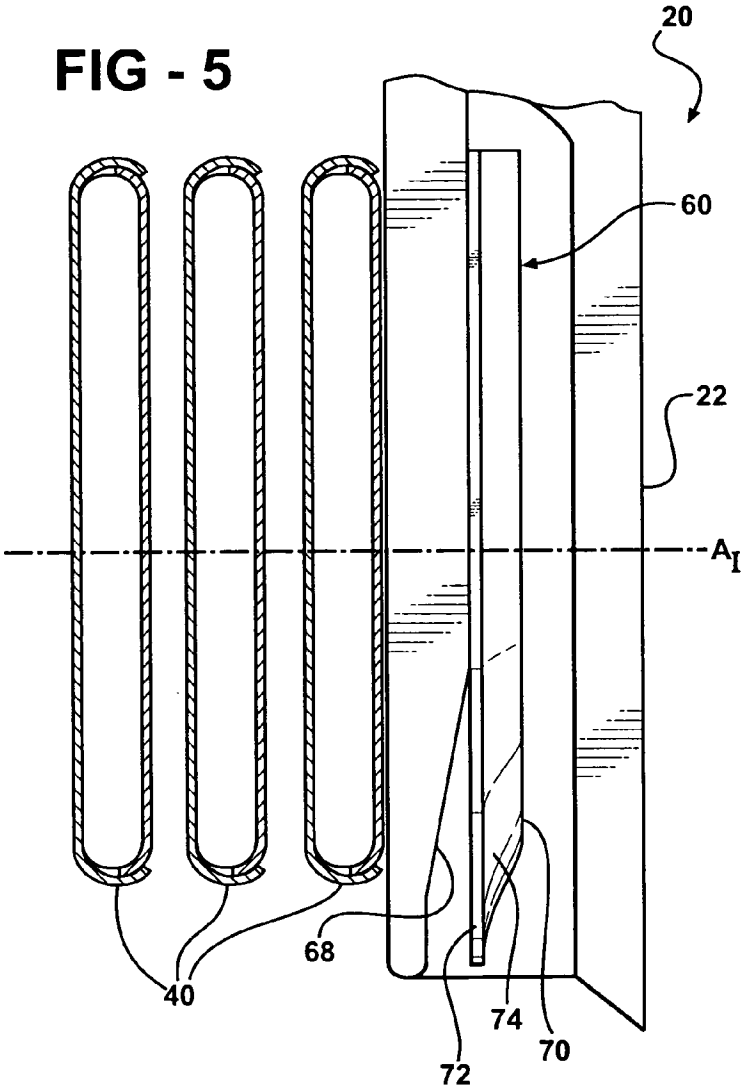
FIG. 5 is a cross-sectional view of the fitting assembly shown in FIG. 2.
Figure 2:
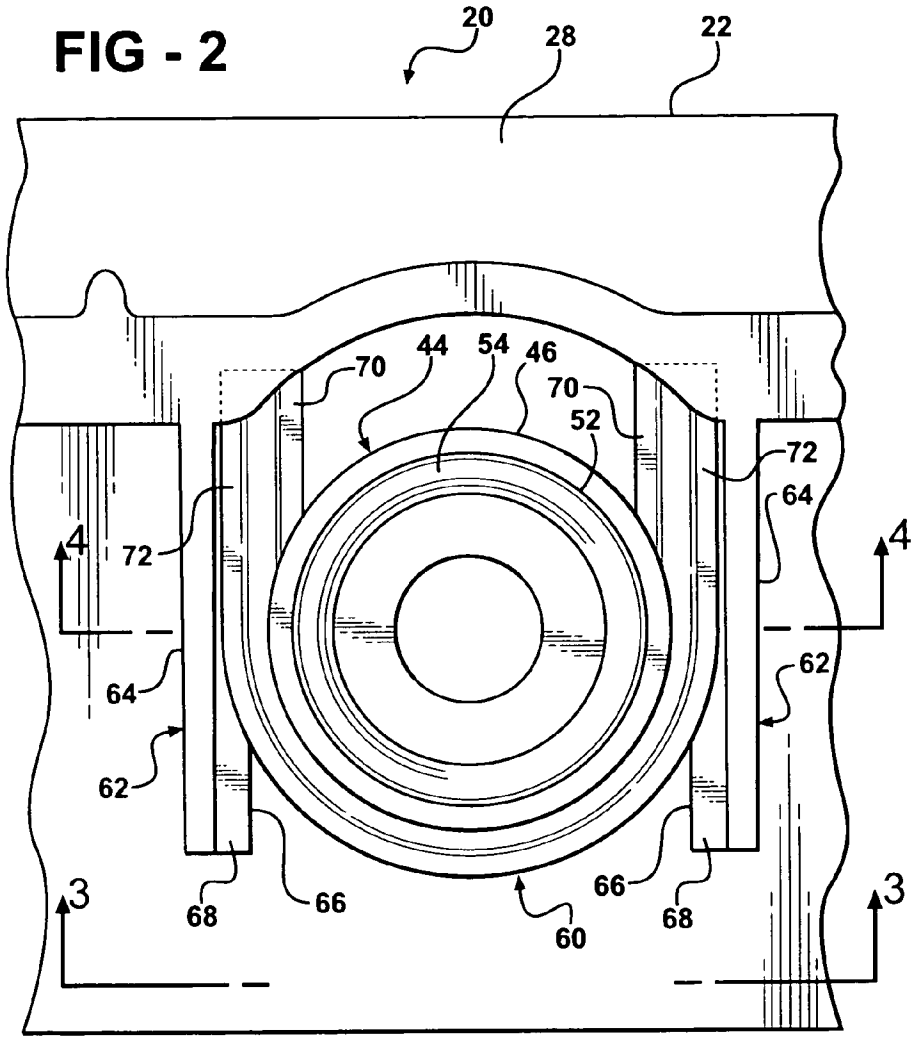
FIG. 2 is a view along the top of the fitting assembly shown in FIG. 1.

Referring to the Figures, wherein like numerals indicate corresponding parts throughout the several views, a radiator assembly for a vehicle cooling system includes an oil cooler assembly. The radiator assembly includes a radiator 20 generally shown. The radiator 20 includes an inlet header tank 22 and an outlet header tank 24. Each of the header tanks 22, 24 are rectangular with a tube wall 26 and an outer wall 28 surrounding said tube wall 26 to define each header tank 22. A plurality of cooling tubes 30 are spaced from each other and extend between the tube walls 26 of the inlet header tank 22 and the outlet header tank 24. A plurality of cooling fins 32 are disposed between adjacent cooling tubes 30 to define a plurality of air passages. At least one of the header tanks 22, 24 includes an inlet cooler opening 34 and an outlet cooler opening 36. The inlet cooler opening 34 is positioned in the outer wall 28 about an inlet axis $A_1$. The outlet cooler opening 36 is positioned in the outer wall 28 and is spaced from the inlet axis $A_1$.

The oil cooler assembly includes an oil cooler 38 generally indicated. The oil cooler 38 includes a plurality of plates 40 each being hollow or containing a heat transfer surface, and spaced from each other. The plates 40 define an inlet manifold 42 and a similar outlet manifold with each providing fluid communication between the plates 40. The oil cooler 38 is disposed within at least one of the header tanks 22, 24. The inlet manifold 42 is axially aligned with the inlet cooler opening 34. Similarly, the outlet manifold is axially aligned with the outlet cooler opening 36.

A fitting 44 generally indicated interconnects each of the manifolds 42 and the respective aligned cooler openings 34, 36. Each of the fittings 44 defines an annular shape and includes a top surface and a bottom surface. The top and bottom surfaces surround a central bore. The top and bottom surfaces extend radially from one axial bore to an axially extending exterior peripheral wall 46. The central bore defines a cylindrical wall extending axially between the top and bottom surfaces. The central bore further defines a tube groove 48 for engaging an oil tube (not shown). A neck 50 extends axially from the top surface and into the associated and aligned cooler opening 34. The top surface includes a recess 52 extending in a circle about and spaced radially from the neck 50 thereof. An o-ring 54 is disposed in the recess 52 of each of the fittings 44 for sealing against the outer wall 28. A rim 56 extends axially from the bottom surface in a circle about the central bore and engages one of the manifolds 42. The axially extending exterior peripheral wall 46 of each of the fittings 44 has a clip-groove 58 extending completely around the exterior peripheral wall 46.

A spring clip 60 generally indicated interconnects each fitting 44 to the inlet header tank 22. The clip 60 shown in FIGS. 6-8 is compressible for spring-like action and biases the fitting 44 into engagement with the outer wall 28 of the associated tank 22, as discussed further below.

Figure 3:
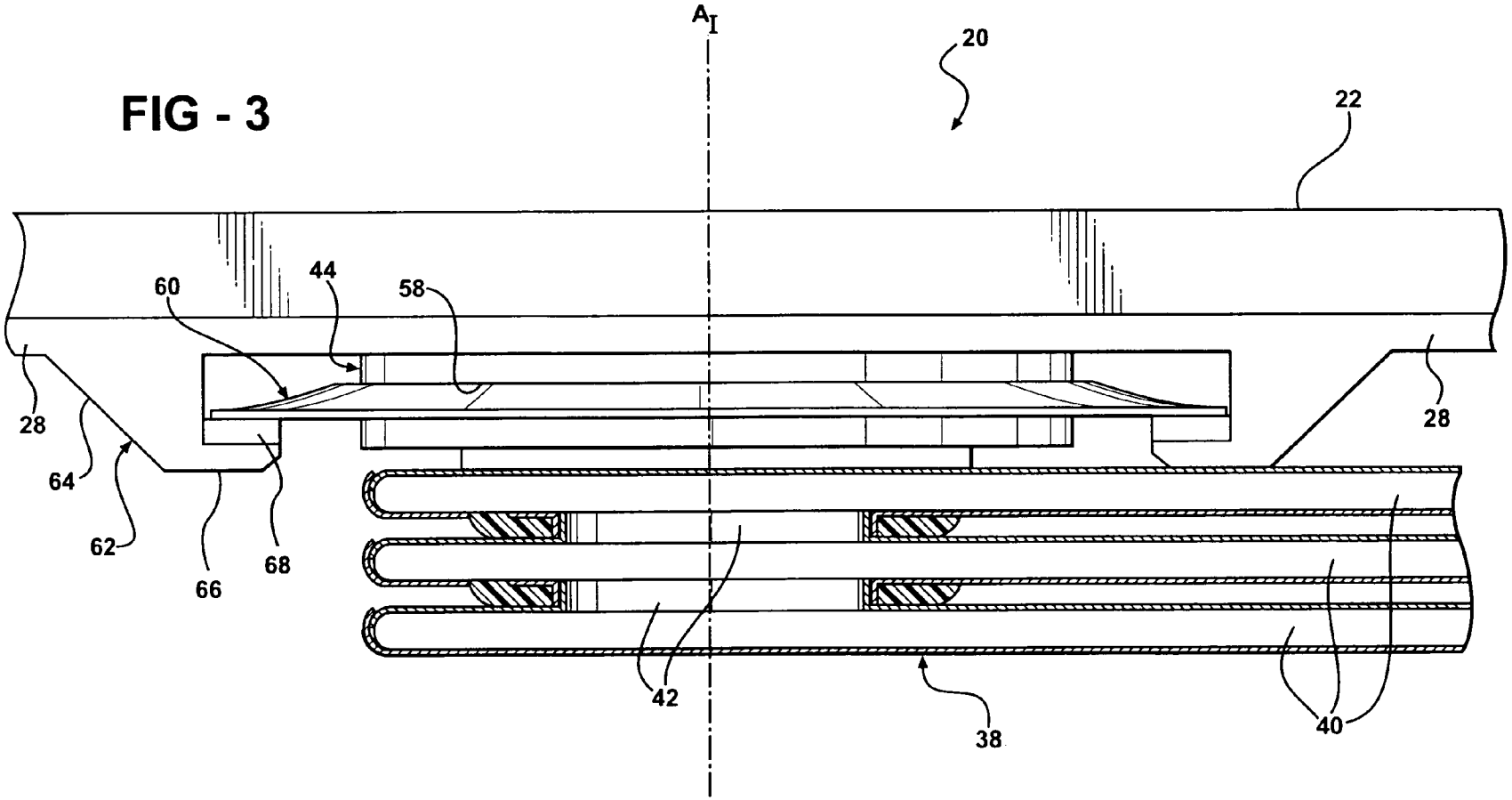
FIG. 3 is a sectional view of the fitting assembly shown in FIG. 2 according to the present invention.

The fitting 44 assembly is distinguished by tracks 62 generally indicated extending from the outer wall 28 within the header tank 22. The tracks 62 are disposed in spaced and parallel relationship on opposite sides of each of the fittings 44. Although FIG. 3 shows the tracks 62 as being integral with the outer wall 28 of the inlet header tank 22 the tracks 62 may be created separate from the outer wall 28 and secured thereto by brazing, or the like. Further, the tracks 62 may be of the same material as the outer wall 28 or of a different material than the outer wall 28. Each of the tracks 62 includes a back surface 64 extending diagonally downward from the outer wall 28 toward the fitting 44 and a ledge 66 extending from the back surface 64 toward the fitting 44. The ledges 66 of the tracks 62 are radially aligned with the clip-grooves 58 in the fitting 44 when the fitting 44 is disposed in one of the cooler openings 34, 36. Each of the ledges 66 includes a ramp 68 for receiving and guiding the clip 60 onto the ledges 66 of the tracks 62.

Figure 4:
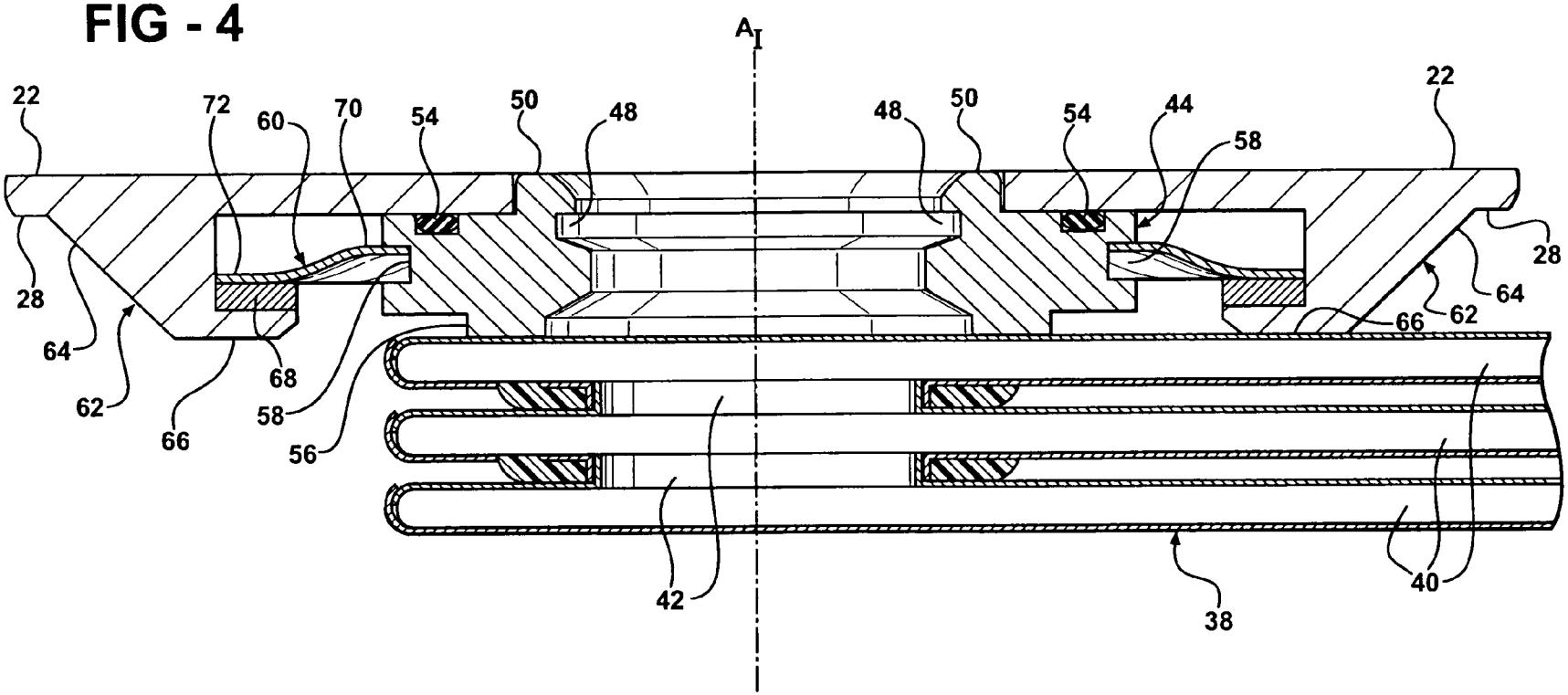
FIG. 4 is a cross-sectional view of the fitting assembly shown in FIG. 3.
Figure 6:
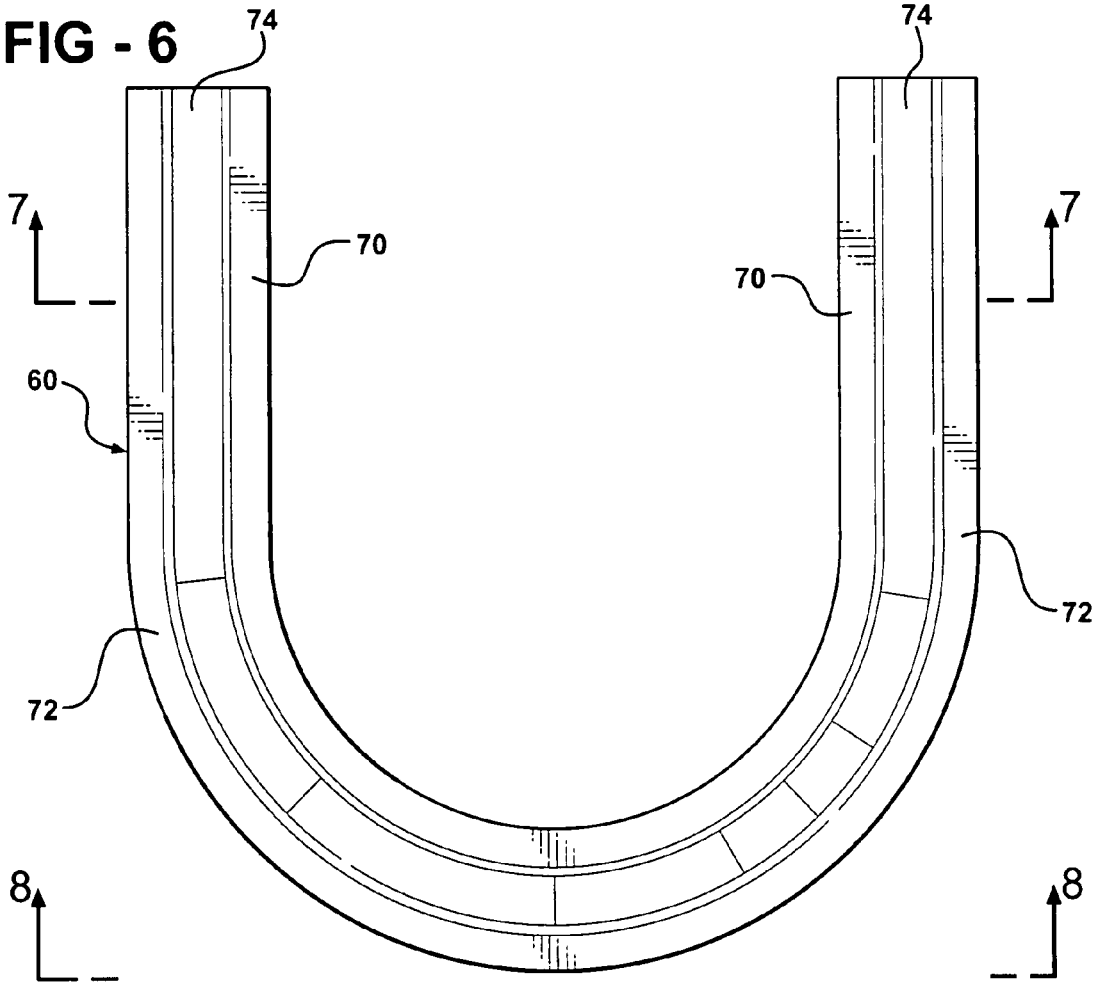
FIG. 6 is a top view of the spring clip included in the fitting assembly of the present invention.
Figure 7:
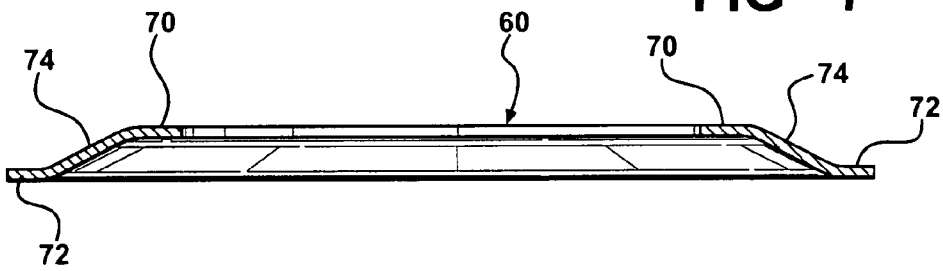
FIG. 7 is a cross-sectional view of the spring clip taken along line 7-7 of the spring clip shown in FIG. 6.
Figure 8:
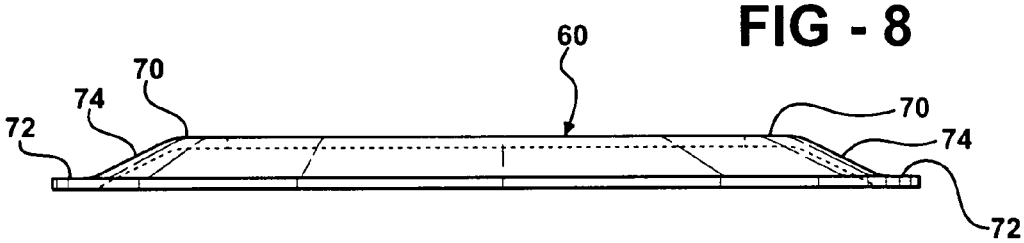
FIG. 8 is an end view of the spring clip shown in FIG. 6.

The spring clip 60 shown in FIGS. 6-8 is U-shaped with parallel and spaced legs. Each leg extends between one of the clip-grooves 58 on one side of the fitting 44 and one of the adjacent ledges 66 for retaining the fitting 44 in engagement with the outer wall 28 of the header tank 22. Each of the legs has a Z-shaped cross-section defining an upper flange 70 in engagement with the clip-groove 58 and a lower flange 72 in engagement with the ledge 66, i.e., the flanges 70, 72 are in parallel and spaced planes. The fitting 44 is placed in a compressed state when the clip 60 engages the ledges 66 and the clip-groove 58, as shown in FIG. 3 and FIG. 4. A slanted section 74 interconnects the parallel and spaced flanges 70, 72 for biasing the fitting 44 into engagement with the outer wall 28 of the header tank 22. The clip 60 forces each of the fittings 44 and the respective o-rings 54 axially against the outer wall 28 of the header tank 22. Accordingly, the o-ring 54 seals the header tank 22 and prevent radiator coolant from leaking out of the header tank 22.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A radiator assembly in a vehicle cooling system including an oil cooler assembly comprising:

a radiator including an inlet header tank having an outer wall with at least one inlet cooler opening therein disposed about an inlet axis, an oil cooler disposed within said inlet header tank, at least one fitting extending into said inlet cooler opening for interconnecting said oil cooler and said header tank of said radiator, a clip for retaining said at least one fitting to said header tank, at least one track extending from said outer wall within said header tank, said clip extending between said at least one track and said at least one fitting within said header tank, said clip configured to bias said at least one fitting into engagement with said outer wall of said header tank in a direction along said inlet axis wherein said outer wall of the header tank includes a pair of tracks extending in spaced and parallel relationship with each other on opposite sides of said at least one fitting;

wherein each of said tracks includes a back surface extending diagonally downward from said outer wall toward said at least one fitting, and a ledge extending from said back surface toward said at least one fitting, said clip engaging said ledge;

wherein each of said ledges includes a ramp for receiving said clip onto said ledge of said tracks;

wherein said at least one fitting includes a clip-groove radially aligned with said ledge of said tracks when disposed in said cooler opening;

wherein said clip is U-Shaped having parallel legs with each leg extending between one of said clip-grooves and an adjacent one of said ledges for retaining said at least one fitting in engagement with said outer wall of said header tank; and, wherein each of said legs has a Z-shaped cross-section defining an upper flange in engagement with said clip-groove and a lower flange in engagement with said ledge and a slanted section interconnecting said flanges for biasing said at least one fitting into engagement with said outer wall of said header tank.

2. The radiator assembly of claim 1 wherein said fitting defines an annular shape with top and bottom surfaces surrounding a central bore and extending radially to an axially extending exterior peripheral wall.

3. The radiator assembly of claim 2 wherein said clip-groove is disposed in said axially extending exterior wall and extends completely around said exterior wall.

4. The radiator assembly of claim 3 wherein said central bore defines a cylindrical wall extending axially between said surfaces and defines a tube groove for engaging an oil tube.

5. The radiator assembly of claim 4 wherein said fitting includes a neck extending axially from said top surface and into said inlet cooler opening.

6. The radiator assembly of claim 5 wherein said top surface of said fitting includes a recess extending in a circle and spaced radially from said neck thereof.

7. The radiator assembly of claim 6 wherein the radiator assembly includes an o-ring disposed in said recess with said clip biasing said fitting and said o-ring axially against said outer wall of said header tank for sealing said o-ring against said outer wall.

8. The radiator assembly of claim 1 wherein said radiator assembly includes an outlet header tank and a plurality of cooling tubes spaced from each other and extending between said header tanks and a plurality of cooling fins disposed between adjacent cooling tubes to define a plurality of air passages.

9. The radiator assembly of claim 1 wherein said oil cooler includes a plurality of plates being hollow and spaced from each other to define an inlet manifold for fluid communication between said plates and an outlet manifold identical to said inlet manifold for fluid communication between said plates.

10. The radiator assembly of claim 9 wherein each of said plates includes a surface for transferring heat.

11. The radiator assembly of claim 9 wherein said fitting includes a rim extending axially from said bottom surface of said fitting in a circle about said central bore, said rim extending into one of said manifolds.

12. The radiator assembly of claim 11 wherein said inlet header tank defines an outlet cooler opening and said inlet manifold is axially aligned with said inlet cooler opening and said outlet manifold is axially aligned with said outlet cooler opening.

13. The radiator assembly of claim 12 wherein said radiator assembly includes a second of said fittings interconnecting said outlet manifold and said outlet cooler opening.

14. A radiator assembly in a vehicle cooling system including an oil cooler assembly comprising:

a radiator including an inlet header tank and an outlet header tank each being generally rectangular with a tube wall and an outer wall surrounding said tube wall to define each header tank and a plurality of cooling tubes spaced from each other and extending between said tube walls of said header tanks and a plurality of cooling fins disposed between adjacent cooling tubes to define a plurality of air passages, at least one of said header tanks having an inlet cooler opening positioned in said outer wall about an inlet axis and a outlet cooler opening positioned in said outer wall about an outlet axis spaced from said inlet axis, an oil cooler including a plurality of plates being hollow or containing a heat transfer surface and spaced from each other, said plates defining an inlet manifold for fluid communication between said plates and an outlet manifold being identical to said inlet manifold for fluid communication between said plates, said oil cooler disposed within one of said header tanks with said inlet manifold axially aligned with said inlet cooler opening and said outlet manifold axially aligned with said outlet cooler opening, a fitting interconnecting—each of said manifolds and the respective aligned cooler openings, each of said fittings defining an annular shape with top and bottom surfaces surrounding a central bore and extending radially to an axially extending exterior peripheral wall, said central bore defining a cylindrical wall extending axially between said surfaces having a tube groove for engaging an oil tube, a neck extending axially from said top surfaces and into said aligned cooler openings, each of said top surfaces including a recess extending in a circle about and spaced radially from said neck, an o-ring disposed in said recess of each of said fittings for sealing against said outer wall, a rim extending axially from said bottom surface in a circle about said central bore and extending into one of said manifolds, said axially extending exterior peripheral wall of each of said fittings having a clip-groove extending completely around said exterior wall, a spring clip for interconnecting each of said fittings to said header tank, a pair of tracks of the same material and homogenous integral with and extending from said outer wall in spaced and parallel relationship on opposite sides of each of said fittings, each of said tracks including a back surface extending diagonally downward from said outer wall toward said fitting and a ledge extending from said back surface toward said fitting, each of said ledges of said tracks being radially aligned with said clip-groove when disposed in each of said cooler openings, each of said ledges including a ramp for receiving said spring clip onto said ledge, said spring clip being U-shaped and having parallel legs with each leg extending between one of said clip-grooves and an adjacent one of said ledges with each leg extending between one of said clip-grooves and an adjacent one of said ledges for retaining said fitting in engagement with said outer wall of said header tank, each of said legs has a Z-shaped cross-section defining an upper flange in engagement with one of said clip-grooves, a lower flange in engagement with one of said ledges, and a slanted section interconnecting said flanges, said slanted section adapted to bias said fitting into engagement with said outer wall of said header tank in a direction along said inlet axis.

15. A fitting assembly for connecting an oil cooler assembly to a header tank of a radiator assembly in a vehicle cooling system comprising:

a fitting for interconnecting a manifold of the oil cooler to a cooler opening of an inlet header tank of a radiator, said fittings defining an annular shape with top and bottom surfaces surrounding a central bore and extending radially to an axially extending exterior peripheral wall, said central bore defining a cylindrical wall extending axially between said surfaces and defining a tube groove for engaging an oil tube, a neck extending axially from said top surfaces for disposing into said cooler opening of the inlet header tank, said top surface including a recess extending in a circle about and spaced radially from said neck, an o-ring disposed in said recess of said fitting for sealing against said outer wall, a rim extending axially from said bottom surface in a circle about said central bore for sealing said manifold of the oil cooler, said axially extending exterior peripheral wall of said fitting having a clip-groove extending completely around said exterior peripheral wall, a spring clip for interconnecting said fitting to said header tank, said spring clip being U-shaped and having parallel legs with each leg engaging said clip-groove of said fitting for retaining said fitting in engagement with said outer wall of said header tank, each of said legs having a Z-shaped cross-section defining an upper flange in engagement with said clip-groove, a lower flange in engagement with a ledge, and a slanted section interconnecting said flanges said slanted section adapted to bias said fitting and said o-ring axially against said outer wall of said header tank.

* * * * *